US006056088A

United States Patent [19]

Gerstenkorn

[11] Patent Number: 6,056,088

[45] Date of Patent: May 2, 2000

[54] ELEVATOR SAFETY CIRCUIT MONITOR AND CONTROL FOR DRIVE AND BRAKE

[75] Inventor: Bernhard Gerstenkorn, Buchrain, Switzerland

[73] Assignee: Inventio AG, Hergiswil NW, Switzerland

[21] Appl. No.: 09/158,020

[22] Filed: Sep. 21, 1998

[30] Foreign Application Priority Data

Sep. 22, 1997 [EP] European Pat. Off. ..... 97810690

[51] Int. Cl.[7] ..... G08B 21/00

[52] U.S. Cl. ..... 187/390

[58] Field of Search ..... 187/247, 280, 187/390, 391, 393; 318/434, 454, 455, 474, 478, 479; 361/30, 79

[56] References Cited

U.S. PATENT DOCUMENTS

| | | | |
|---|---|---|---|
| 3,882,969 | 5/1975 | Podcameni et al. | 187/29 R |
| 5,107,964 | 4/1992 | Coste et al. | 187/104 |
| 5,270,498 | 12/1993 | Tanahashi | 187/116 |
| 5,487,448 | 1/1996 | Schollkopf et al. | 187/247 |
| 5,616,895 | 4/1997 | Spiess | 187/280 |
| 5,635,688 | 6/1997 | Kantesaria et al. | 187/292 |

FOREIGN PATENT DOCUMENTS

| | | |
|---|---|---|
| 394 022 | 1/1992 | Austria . |
| 0 535 205 | 4/1993 | European Pat. Off. . |
| 0 767 133 | 4/1997 | European Pat. Off. . |
| 2 110 388 | 6/1983 | United Kingdom . |

*Primary Examiner*—Jonathan Salata
*Attorney, Agent, or Firm*—Macmillan, Sobanski & Todd, LLC

[57] ABSTRACT

Monitoring equipment for an elevator drive control includes two modules, a safety circuit sensor system and a motor-switching and/or brake-switching circuit, wherein the monitoring of a safety circuit and the consequential actions resulting therefrom takes place exclusively by means of electronic components while avoiding electrically conductive separating locations. By the use of electronic components, electromechanical switching elements, which have electrically conductive separating locations, can be dispensed with. In addition, an appreciable reduction in the noise level is achieved, since switching noises no longer arise. This has an advantageous effect particularly in the case of elevator installations without a machine room. Furthermore, the manufacturing costs can be significantly reduced and a high security and reliability of the monitoring equipment can be ensured by the use of usual electronic components.

20 Claims, 5 Drawing Sheets

ELEVATOR SAFETY CIRCUIT MONITOR AND CONTROL FOR DRIVE AND BRAKE

BACKGROUND OF THE INVENTION

The invention concerns equipment for monitoring an elevator drive control and, in particular, equipment for monitoring a safety circuit of an elevator drive control.

In the case of present day elevator installations with frequency converter drives and microprocessor controls, mainly electromechanical contactors are used for the monitoring of the safety circuit and the consequential actions connected therewith, such as the brake actuation, the switching-on and switching-off of motor current and the loading of the intermediate circuit of the frequency converter with a defined switching-on current.

With electromechanical relays or also contactors, the mechanical contacts wear in use. Furthermore, contactors or relays cause appreciable noise emissions, which prove to be disturbing particularly in the case of elevator installations in residential or commercial buildings, during switching operations. Finally, contactors and relays require appreciable financial expenditure also by reason of their limited service life and frequent exchange.

Disadvantages also result due to the manner of operation of the safety circuit. Until today, the checking or the detection of the state of the safety circuit was performed by means of electromechanical contactors or relays. These contactors or relays in that case serve as sensors. However, this entails the following diverse disadvantages in an alternating current safety circuit:

Very long, parallelly laid electrical lines occur in an elevator installation. Due to the capacitance between the conductors, alternating voltage can be transmitted from one conductor to the other. Due to this effect, the mains voltage can be coupled into the safety circuit. This can have the consequence that contactors or relays do not drop off when a safety contact opens in the safety circuit, because the drop-off voltage in the case of alternating current contactors or relays is about one tenth of the attraction voltage.

The same can happen when the voltage of the safety circuit is transmitted from one conductor of the safety circuit to a safety contact on the return conductor.

Alternating current contactors or relays need a large switching-on current. In the case of a long safety circuit, the internal resistance is so great that special measures are required for voltage adaptation for the reliable switching-on.

The operating voltage of the safety circuit is mostly in the range of 110 to 230 volts. For that reason, a protection against contact is required at all accessible places.

The service life of the contactors and relays is greatly restricted by reason of the mechanical wear.

Equally, disadvantages result in the case of a direct current safety circuit:

The direct current leads to wear at the contact transitions of the safety contacts due to material migration.

A monitoring device for a control device for elevator installations and conveying installations, which is provided with an electronic and testable switching device, which comprises a sensor and is initiatable without contacts and with the aid of which the state of the sensor is detectable, is shown in the European patent document EP-0 535 205. These contactless switching devices are to be used, for example, for the monitoring of the door latches.

In the case of the monitoring equipment described above, switching devices are used, which indeed eliminate the disadvantages of electromechanical switches, but are more expensive by a multiple, so that use is not worthwhile on cost grounds. Furthermore, this monitoring equipment requires complex electrical circuitry. Due to the capacitive cross talk, no loop can be formed in the case of longer electrical lines as is the case for a safety circuit for elevator installations. At the end of a line that can extend over several contacts, a signal converter must be used in order that the signal running back parallelly to the source signal can be distinguished from the source signal possibly coupled in capacitively.

SUMMARY OF THE INVENTION

The present invention has the object of providing a monitoring equipment for a drive control for elevators which does not have the aforementioned disadvantages:

Advantages achieved by the invention are that the monitoring equipment consists of a safety circuit sensor system and a motor-switching and brake-switching circuit, which stand in connection one with the other, wherein the monitoring equipment consists exclusively of electronic components while avoiding electrically conductive separating locations. Due to the use of electronic components, electromechanical switching elements, which have electrically conductive separating locations, can be dispensed with. Through the use exclusively of electronic components, an appreciable reduction in the noise level is achieved, since no switching noises any longer arise. This has an advantageous effect particularly in the case of elevator installations without machine room. Furthermore, due to the use of usual electronic components, the manufacturing costs can be significantly reduced and a high security and reliability of the monitoring equipment can, in addition, be ensured.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
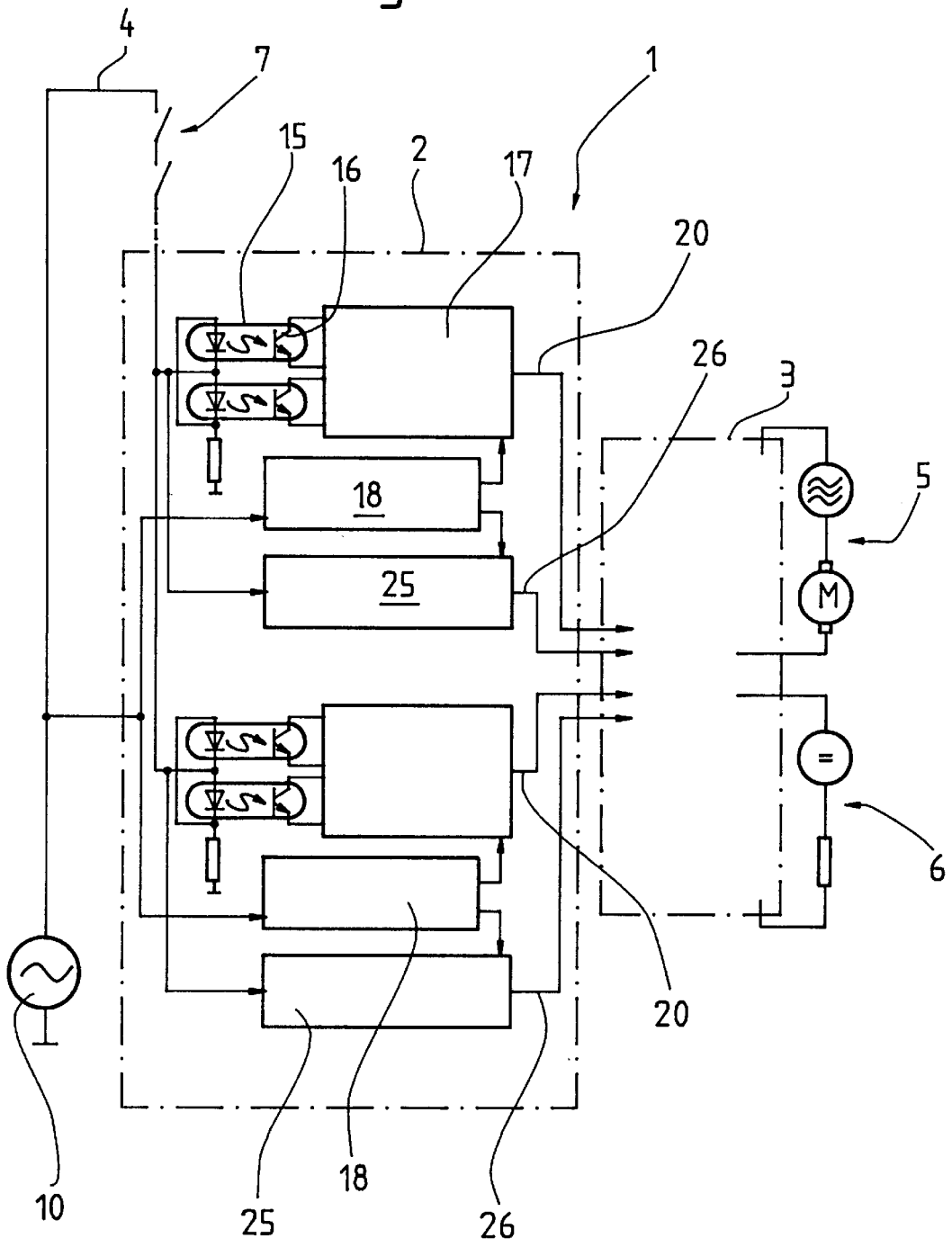
FIG. 1 is a schematic illustration of a first embodiment monitoring equipment according to the present invention for an alternating current safety circuit with a safety circuit sensor system and a motor-switching and brake-switching circuit.

A schematic illustration of monitoring equipment 1 for an elevator drive control according to a first embodiment of the present invention with a safety circuit sensor system 2 and a motor-switching and brake-switching circuit 3 for an alternating current safety circuit 4 is shown in the FIG. 1. The safety circuit sensor system 2 is responsible for the monitoring of the safety circuit 4, for example whether the safety circuit is open or closed. The motor-switching and brake-switching circuit 3 is responsible for the consequential actions resulting therefrom with respect to an elevator drive motor 5 and an associated brake 6, respectively. Several contacts 7, which must be monitored, are present, for example at the elevator shaft doors, in the safety circuit 4, which is looped through the elevator car and shaft.

A solution for the alternating current safety circuit 4 and the safety circuit sensor system 2 is described in the following, with values by way of example.

A signal source 10 of the safety circuit 4 must be distinguishable in frequency from the main voltage (typically 230 volts, 50/60 hertz), for example 200 hertz, and the voltage shall amount to 24 volts (protection in case of human contact).

It must be made certain by the build-up of the safety circuit sensor system 2 that the downstream device can be switched off in the case of any desired combination of three faults under desired operating conditions. For that reason, the safety circuit sensor system 2 must supply four output signals. Safety against three faults requires the use of four sensors inclusive of the electronic evaluating system. Because of the contact crosstalk capacitance between the conductors of the safety circuit 4, it is not ascertainable by voltage measurement on its own whether the load/measuring resistor has an interruption. For that reason, the voltage and the current of the safety circuit 4 must be measured. In that case, the current measurement must take place through an element with energy transmission.

The distinction between the operating frequency of 200 hertz and the interference frequency of 50/60 hertz as well as the phase shift in the case of capacitive contact cross-talk takes place through synchronization with the signal source 10. The maximum possible current in the open safety circuit 4 shall be at least three times smaller than the minimum current in the closed safety circuit, at which a current sensor switches in. Furthermore, a voltage sensor shall switch off when the phase shift relative to the source signal amounts to more than sixty degrees.

For example, optical couplers (or also transformers) with a defined transmission factor are used as current sensors 15. In order that a defined current threshold can be ascertained, an output transistor 16 is fed by a current source. Thereby, a respective signal is produced for each of a negative and a positive safety circuit current, filtered subsequently in an evaluating unit 17 and processed further digitally. These two signals are interlinked in the evaluating unit 17 with a synchronizing signal from a synchronizing unit 18. Thereby, false signals, for example the interference frequency of 50 or 60 hertz, can be suppressed at least for half periods. Furthermore, the evaluating unit 17 of the current sensor 15 contains flip-flops that produce a reset pulse for a counter in case no valid signal would be present in a half period. In the case of absent synchronizing signal, the flip-flops would not, however, produce any reset pulses. For this reason, a monitoring circuit resets the counter when the synchronizing signal is absent.

The output signals are combined and fed to a counter. For a defined counter state, a current sensor output 20 reaches a logic state "1", which means that the safety circuit 4 is closed. At the same time, the counter input is blocked.

The digital part of the evaluating unit 17 can also be realized by means of PAL, GAL, EPLD or ASIC.

In the synchronizing unit 18, a rectangular signal is produced from the source signal for the synchronization of the current sensors 15 and of voltage sensors 25. An operational amplifier is in that case connected as a bandpass filter and takes care of level matching at the same time. Signals at low and high frequencies are suppressed.

The voltage sensor 25 contains an operational amplifier, which is connected in the same manner as in the synchronizing unit 18, and an operational amplifier that inverts this signal. Analog switches transmit the signals of these two operational amplifiers piece by piece to an active asymmetric filter (operational amplifier connected as active lowpass filter). If the sensor input signal in that case agrees with the source signal, the analog switches act like a rectifier. If this is not the case, the sensor input signal is chopped and greatly attenuated by the following filter. A diode before the lowpass filter ensures that negative input signals act in amplified manner (about 10 times) on a filter capacitor in the direction of switching-off. A further operational amplifier is connected as threshold value switch with hysteresis and supplies the signal at a voltage sensor output 26.

In order to obtain the four output signals of the safety circuit sensor system 2, the aforedescribed sensors and the synchronization are implemented twice as shown.

Taps in the safety circuit 4 for diagnostic functions need not be fault-proof and are built up like the voltage sensor 25, since the safety circuit must not be greatly loaded in terms of current by the taps.

As variant of the aforedescribed solution, the signal evaluation can also be realized by digital scanning. In the following, the circuit is described by reference to the voltage sensor. A scanning signal, which at the instant of the maximum voltage has the logic state "1", is produced by way of synchronization from the source signal. If the voltage of the safety circuit 4 at this instant lies above a threshold value, a counting pulse for a counter is generated. If this is not the case or the scanning signal is absent, the counter receives a reset pulse.

Figure 2:
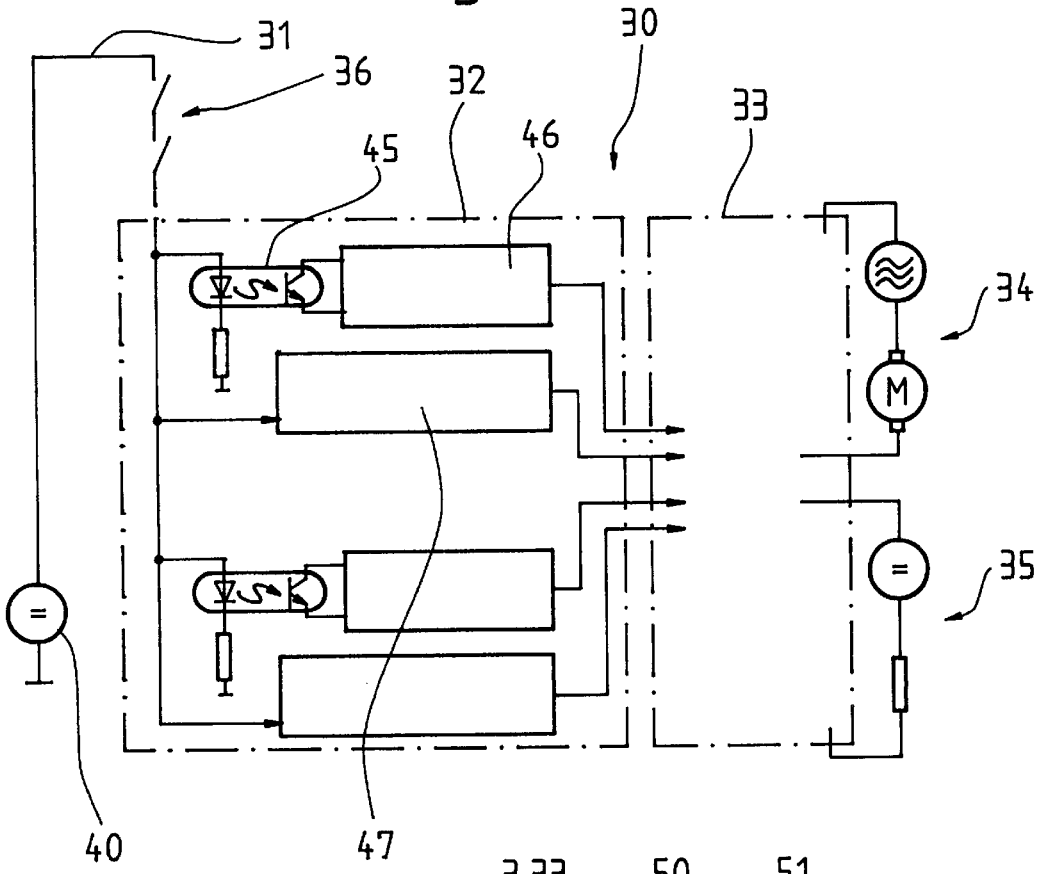
FIG. 2 is a schematic illustration of a second embodiment monitoring equipment according to the present invention for a direct current safety circuit with a safety circuit sensor system and a motor-switching and brake-switching circuit.

A schematic illustration of a second embodiment monitoring equipment 30 according to the present invention for a direct current safety circuit 31 with a safety circuit sensor system 32 and a motor-switching and brake-switching circuit 33 is shown in the FIG. 2. The safety circuit sensor system 32 is responsible for the monitoring of the safety circuit 31 and the motor-switching and brake-switching circuit 33 for the consequential actions resulting therefrom with respect to an elevator drive motor 34 and an associated brake 35, respectively. Several contacts 36, which must be monitored and are, for example, at the shaft doors, are present in the safety circuit 31, which is looped through the elevator car and the shaft.

The safety circuit sensor system 32 with the safety circuit 31 operated by direct current is much simpler than the alternating current version discussed above, as is already evident from FIG. 2.

The synchronization with the source signal becomes superfluous and the evaluation need be realized only for one current/voltage direction.

A solution for the direct current safety circuit 31 and the safety circuit sensor system 32, with values by way of example, is described in the following.

A signal source 40 of the safety circuit 31 is operated by direct current. The voltage and the current in the safety circuit 31 must be so chosen that the material migration is negligibly small at the contacts 36. Furthermore, the voltage shall be smaller than sixty volts for reasons of protection in case of human contact. For these given conditions, the voltage can be, for example, forty-eight volts (protection in case of human contact). The coupling of the mains voltage into the safety circuit 31 furthermore forms a source of interference in the case of operation with direct current. The filtering-out of this interference leads to the response time of the evaluating circuit being greater than for the previously described alternating current safety circuit.

A current sensor 45 consists of an optical coupler with current feed as described in the alternating current safety circuit above. Thereby, a signal is produced which is subsequently filtered in an evaluating unit 46 in order to suppress fifty hertz interference signals of the mains voltage and is processed further digitally. The build-up of the evaluating unit 46 is substantially identical with that of the alternating current safety circuit.

A voltage threshold value switch with hysteresis and a following filter is, for example, used as a voltage sensor 47 in order to suppress fifty hertz interference signals of the mains voltage.

In order to obtain the four output signals of the safety circuit sensor system 32, the aforedescribed sensors are implemented twice as shown.

Safety circuit taps for diagnostic functions are also to be built up here like the voltage sensors 47.

Figure 3:
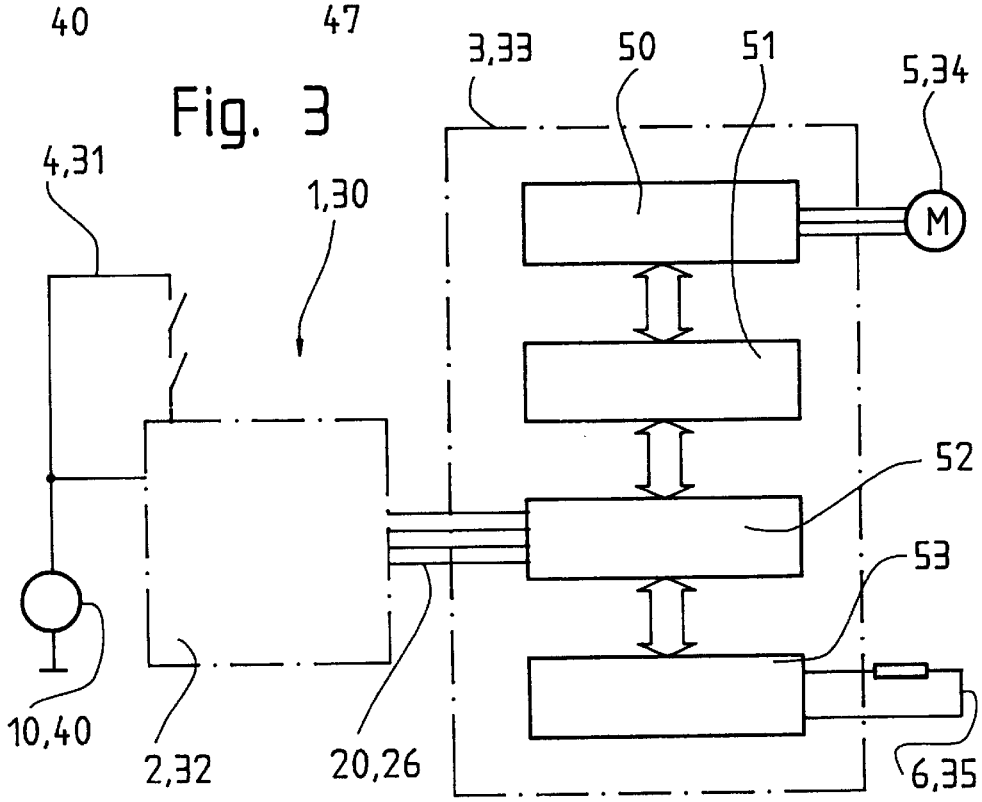
FIG. 3 is a schematic illustration of the motor-switching and brake-switching circuit shown in the FIG. 1 and the FIG. 2.

FIG. 3 shows an schematic block diagram illustration of the monitoring equipment according to the present invention representing the first embodiment monitoring equipment 1 and the second monitoring equipment 30 with the corresponding motor-switching and brake-switching circuits 3 and 33. The safety circuits 4 and 31 described in connection with the FIGS. 1 and 2 respectively, the signal sources 10 and 40, as well as the safety circuit sensor systems 2 and 32 with the connection to the motor-switching and brake-switching circuits 3 and 33, respectively, the current sensor outputs 20 and the voltage sensor outputs 26 are illustrated schematically.

In the main, the motor-switching and brake-switching circuits 3 and 33 consist of a frequency converter power unit 50, a VVVF drive/control unit 51 (wherein VVVF signifies variable voltage and variable frequency), an intelligent protection system 52 and a brake control 53.

The frequency converter power unit 50 contains all electronic power elements in order to convert the mains voltage into an intermediate circuit direct voltage and therefrom into the polyphase alternating current for the drive motors 5 and 34. The VVVF drive/control unit 51 is the combination of the components of drive regulation and elevator control. The VVVF drive/control unit 51 controls the frequency converter power unit 50 and is on the other hand addressed as interface by the intelligent protection system 52. The intelligent protection system 52 is the safety module of the electrical drive. It consists of an electronic safety circuit and monitors all functions relevant to safety. When the safety circuits 4 and 31 open, the intelligent protection system 52 activates the corresponding one of the brakes 6 and 35 and switches off the energy flow to the corresponding one of the drive motors 5 and 34. If the intelligent protection system 52 ascertains a faulty function, the elevator is stopped in addition. The brake control 53 contains all switching elements in order reliably to switch the brakes 6 and 35 on and off. The brake control 53 must meet the highest safety demands and is therefore checked directly and continuously by the intelligent protection system 52.

Figure 4:
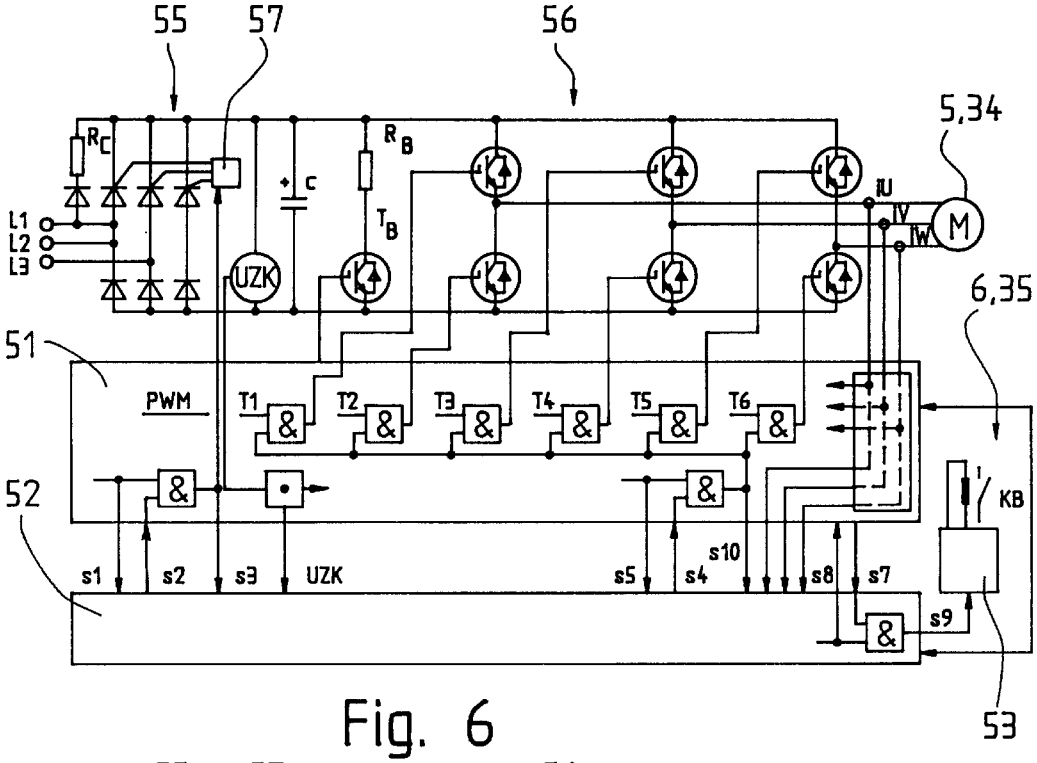
FIG. 4 is a schematic illustration of a first embodiment of a motor control.

FIG. 4 shows a first embodiment of a motor control. The interface between the VVVF drive/control unit 51 and the intelligent protection system 52 hereby becomes very simple without electromechanical relays. The energy flow forming the polyphase alternating current to the drive motor 5 (34) can be locked and freed through the intelligent protection system 52 by two switching elements, an input rectifier 55 and an IGBT inverter 56 by way of the VVVF drive/control unit 51. The input rectifier 55 fed by three phases L1, L2 and L3 consists of a thyristor half-bridge with rectifier control 57. The input rectifier 55 can be switched on and off by the rectifier control 57. When it is switched off, only a small amount of current flows through a charge resistor $R_c$. Control signals T1 to T6 of a pulse width modulation unit PWM (not shown) for the drive control of the IGBT's of the inverter 56 are checked as a block and freed by the intelligent protection system 52 by way of a logical interlinking in the VVVF drive/control unit 51.

Measurement signals of the motor current $i_u$, $i_v$ and $i_w$ are preliminarily processed by the VVVF drive/control unit 51 and passed on to the intelligent protection system 52.

Figure 5:
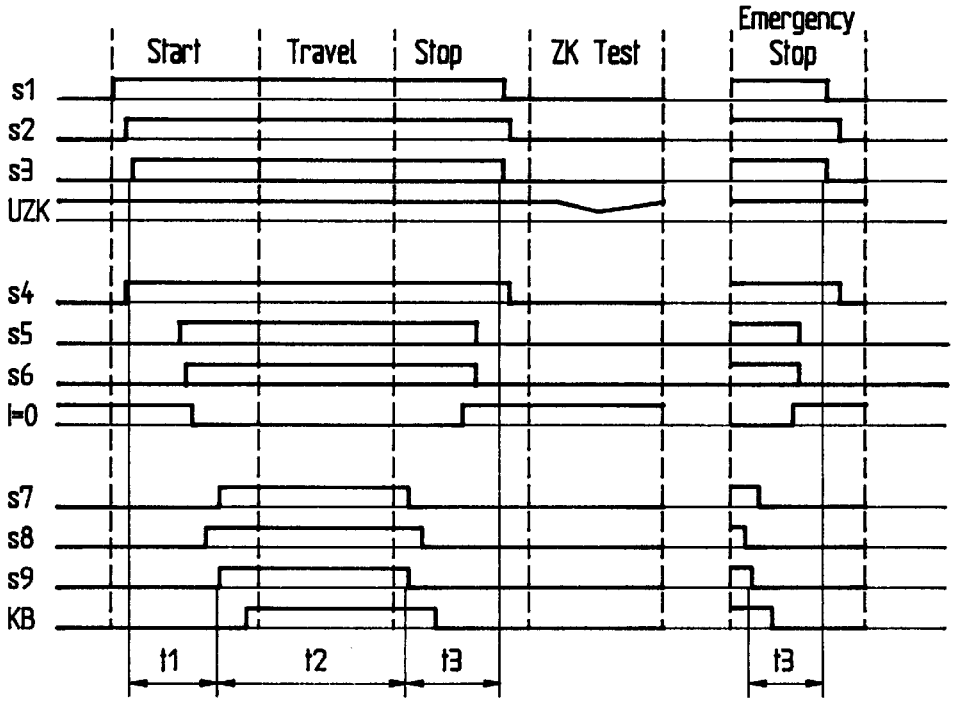
FIG. 5 is a signal waveform plot for the monitoring functions of the first motor control shown in the FIG. 4.

The description of the monitoring function of the intelligent protection system 52 for the freeing and the blocking is described in the following by reference to a time sequence during the switching of the signals shown in the FIG. 5 and corresponds with the first embodiment of the motor control according to the FIG. 4.

Description of the sequences:

Start Sequence:

The VVVF drive/control unit 51 switches a signal s1="1" and thereby informs the intelligent protection system 52 that travel is to be started. As soon as the safety circuit is closed, the intelligent protection system 52 frees the inverter operation by generating signals s2=s4="1". The intelligent protection system 52 measures a time "t1" from the freeing of the start, which is valid only for a certain time. The VVVF drive/control unit 51 frees the IGBT's by a signal s5="1" in order to build up the holding torque in the drive motor 5 (34). The motor current $i_u$, $i_v$ and $i_w$ begins to rise and (i=0) becomes zero. The intelligent protection system 52 frees the brake 6 (35) by a signal s8="1". When the VVVF drive/control unit 51 has built up the holding torque, the brake 6 (35) is activated by a signal s7="1" by way of a brake control 53. When the brake shoes are drawn off, a signal KB becomes equal to "1" and the travel can start.

Travel Sequence:

The intelligent protection system 52 measures a time "t2" from the switching-off of the brake magnet current. If this time exceeds a certain value, an emergency stop is initiated. This monitoring is imperative in order that it is made certain that all elements are checked once within a certain time.

Stop Sequence:

The elevator car is at standstill and the VVVF drive/control unit 51 switches off the brake 6 (35) by way of the signal s7="0". After KB="0", the VVVF drive/control unit 51 regulates the motor current towards zero (i=0) becomes "1" and subsequently switches off the IGBT module 56 by the signal s5="0" and the rectifier 55 by the signal s1="0". The switching-off sequence is monitored by the intelligent protection system 52. The stop sequence is concluded by the signals s5=s2="0". A time "t3" of the switching-off sequence is monitored by the intelligent protection system 52.

Intermediate Circuit Voltage Test:

Subsequent to the stop sequence, an intermediate circuit capacitor C under the control of the VVVF drive/control unit 51 through a transistor $T_B$ and a resistor $R_B$ is discharged so far that the intelligent protection system 52 can ascertain by reference to an intermediate circuit voltage UZK whether the input rectifier 55 is switched off. Thereafter, the drive is freed for a certain time (in the range of minutes or hours) for a new start. If this time is exceeded, a new intermediate circuit voltage test must be performed.

Emergency Stop:

An emergency stop is initiated when the intelligent protection system 52 ascertains a faulty function or the safety circuit is interrupted. The protection system 52 switches the brake 6 (35) off by way of the signal s8="0". By the signal s8="0", the VVVF drive/control unit 51 is informed that an emergency stop is present and the motor current must be regulated to zero and the IGBT module and the rectifier must be switched off. The switching-off sequence is monitored by the intelligent protection system 52. It is checked that the time "t3" of the switching-off operation does not exceed a certain value. On exceeding the permissible time, switching off is done by way of the signals S4 and s2 according to emergency. The emergency stop sequence is concluded by the signals s4=s2="0".

Figure 6:
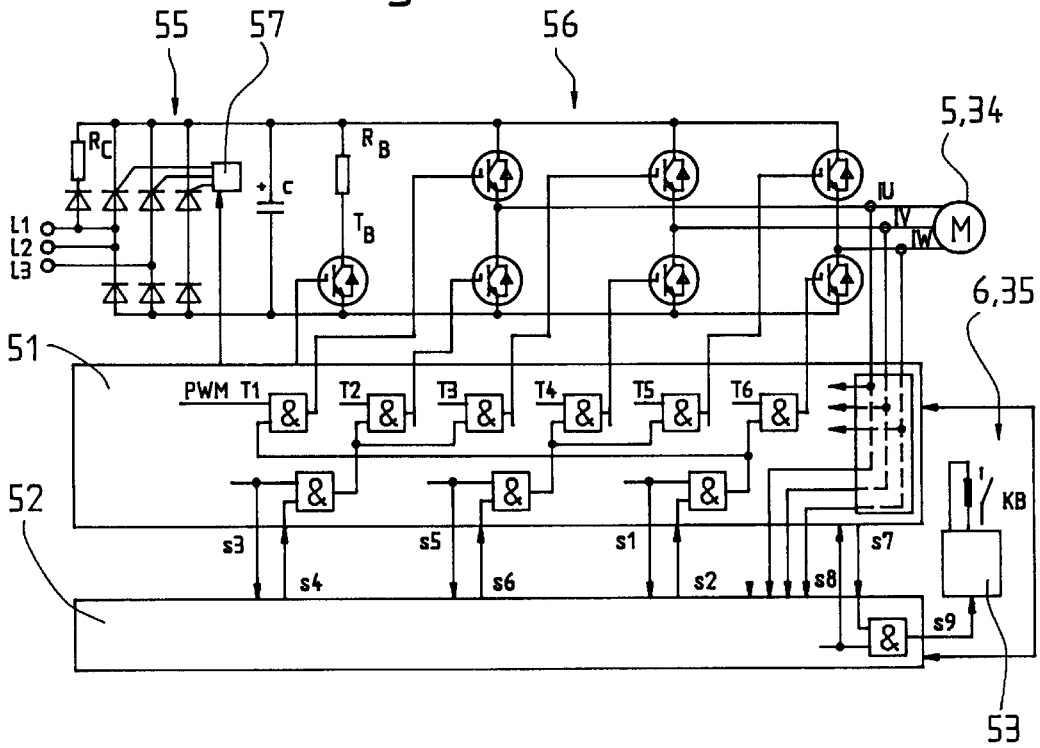
FIG. 6 is a schematic illustration of a second embodiment of a motor control.

FIG. 6 shows a second embodiment of a motor control. In place of the input rectifier 55, a more extensive circuit can also be used for a mains return feed. For this reason, a solution without monitoring of the input rectifier 55 is described in this second embodiment. Furthermore, the IGBT's of the inverter 56 are no longer checked and freed as a block, but in groups of two, by the intelligent protection system 52.

Figure 7:
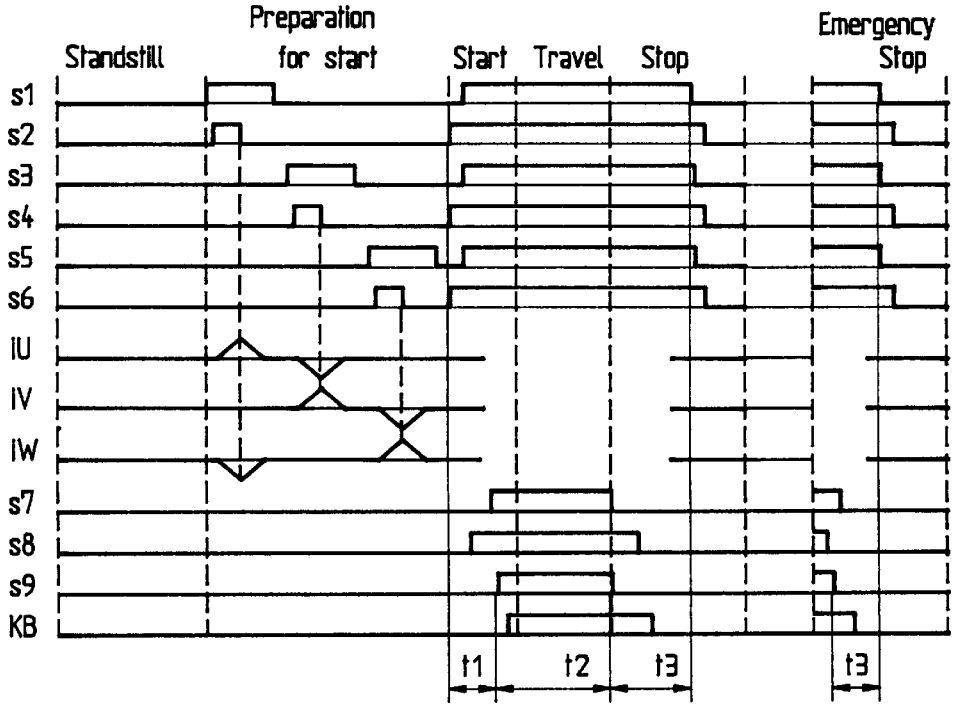
FIG. 7 is a signal waveform plot for the monitoring functions of the second motor control shown in the FIG. 6.

The description of the monitoring function of the intelligent protection system 52 for the freeing and the blocking is described in the following in FIG. 7 with the aid of the time sequence during the switching of the signals and corresponds with the second variant of the motor control according to FIG. 6.

Description of the sequences:

Standstill:

The switching means (IGBT) and the brake 6 (35) are blocked by the intelligent protection system 52. The signals s2, s4, s6 and s8 are zero.

Preparation for start:

The VVVF drive/control unit 51 wants to begin a travel. Before the travel is freed by the protection system 52, the switching means must be checked. For this purpose, the VVVF drive/control unit 51 produces the PWM signal for the transistors so that they can be switched on for the tests. The transistors cannot be switched on statically for a longer time because the current in the motor winding would become too great in standstill. By switching-on of the signal s1, the VVVF drive/control unit 51 informs the protection system 52 that the path T1 and T6 are to be checked. The protection system 52 switches the signal s2 on. The currents $i_u$ and $i_w$ rise. The protection system 52 measures the current and switches S2 off again after the defined time, so that the current tends to zero. Subsequently, the same occurs for the other two transistor pairs. After successful test and when the safety circuit is closed, the intelligent protection system 52 frees the inverter 56 for travel through the signals s2=s4=s6="1". The freeing is valid only for a certain time, wherein the time "t1" is measured from the freeing of the start.

Start Sequence:

The VVVF drive/control unit 51 switches the transistors on in order to build up the holding torque in the drive motor 5 (34). The intelligent protection system 52 frees the brake 6 (35) by the signal s8="1". When the VVVF drive/control unit 51 has built up the holding torque, the brake 6 (35) is activated by the signal s7="1" by way of the brake control 53. When the brake shoes are drawn away, the KB signal becomes equal to "1" and the travel can begin.

Travel:

The intelligent protection system 52 measures the time "t2" from the brake activation. If the time "t2" exceeds a certain value, an emergency stop is initiated. This monitoring is imperative in order that it is made certain that all elements are checked once within a certain time.

Stop

The car is at standstill and the VVVF drive/control unit 51 switches off the brake 6 (35) by way of the signal s7="0". After the KB signal has become "0", the VVVF drive/control unit 51 regulates the motor current towards zero and subsequently switches off the signals s1, s3 and s5. The protection system 52 then also switches off the signals s2, s4 and s6. The time "t3" of the switching-off sequence is monitored by the protection system 52.

Emergency stop:

An emergency stop is initiated when the protection system 52 ascertains a faulty function or the safety circuit is interrupted. The protection system 52 switches off the brake 6 (35) by way of the signal s8="0". The VVVF drive/control unit 51 is informed by the signal s8="0" that an emergency stop is present and the motor current must be regulated to zero and switched off. The intelligent protection system 52 monitors that the time "t3" does not exceed a certain value, otherwise switching-off is done by means of the signals s2, s4 and s6.

Figure 8:
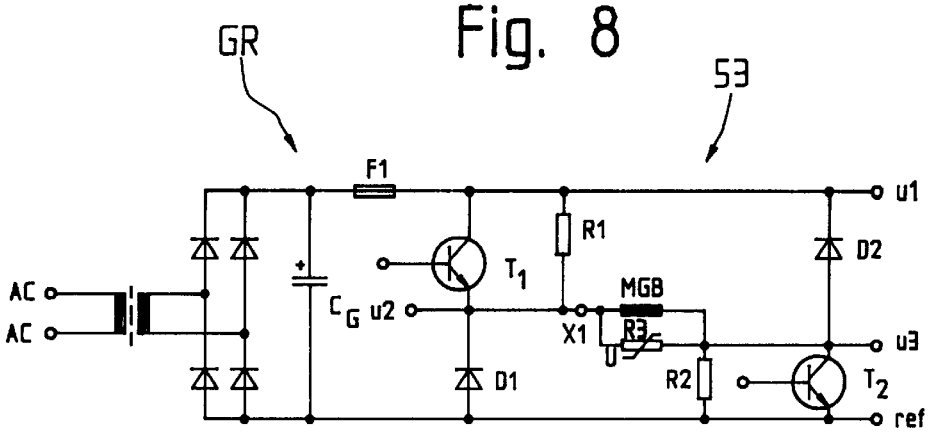
FIG. 8 is a schematic illustration of the brake control shown in the FIG. 3.

FIG. 8 shows an embodiment of the brake control 53. The brake control 53 is responsible for a drive control of the brake 6 (35). It must be prevented absolutely that the brake current can no longer be switched off. The elevator car could drift away, which can lead to a dangerous state. For this reason, the brake voltage should be reduced as soon as the armature of the brake magnet MGB is attracted. Before the switching-on of the brake current, the switched-off state is ascertained unambiguously by the protection system 52 by voltage measurement at all switching members.

The direct voltage for the operation of the brake 6 (34) can be produced either by a rectifier GR, a transformer or by a switched power supply. In that case, the switched power supply has the advantage that the output voltage is switchable on, off and over and has a small tolerance.

The energy of the brake magnet MGB can, on switching-off, be converted into, for example, heat in a varistor R3 or be fed back into a smoothing capacitor $C_G$. The reduction in the power can in this circuit take place through keying of a transistor. When a transistor $T_1$ or $T_2$ is for example switched on only for 50% of the time, the brake magnet current flows in the other 50% through a freewheel diode D1 or D2 respectively. Thereby, the mean brake voltage is halved.

When the brake 6 (34) is switched on, a functional test of the transistors $T_1$ and $T_2$ can take place in that the transistors are switched off briefly in alternation. While the transistor is switched off, the current flows through the freewheel diode D1 and D2 in the same branch. When the brake 6 (34) is switched off, a small current flows through the resistors R1 and R2. Thereby, it can be checked by the protection system 52 by reference to the voltages u1, u2 and u3 whether the transistors $T_1$ and $T_2$ are short-circuited. The power in the brake 6 (34) can be controlled as desired by increasing the switch-off time.

As further variant, a relay contact can be connected in series with the brake magnet MGB at a point X1 to increase the security. This relay is so controlled by the intelligent protection system 52 that it switches free of power in normal operation. The relay must be able to switch off the brake current only when a transistor is defective. The functional check of this relay can take place by way of the protection system 52 by voltage measurement or by means of a constrainedly guided opening contact.

Figure 9:
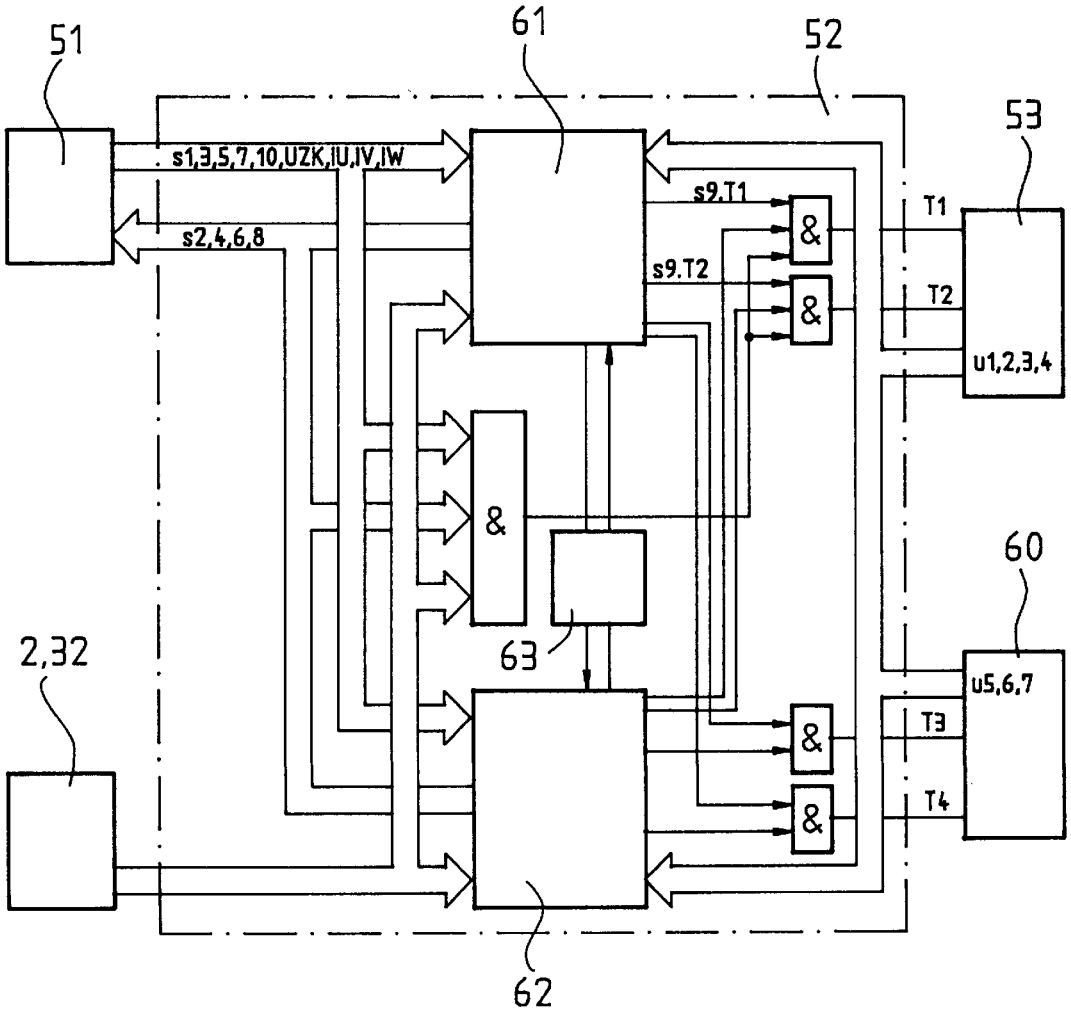
FIG. 9 is a schematic illustration of the intelligent protection system shown in the FIG. 3.

FIG. 9 shows a schematic illustration of the intelligent protection system 52 with the associated interfaces to the safety circuit sensor system 2 (32) to the VVVF drive/control unit 51, to the brake control 53 and to a brake relay control 60 necessary in the aforedescribed variant. The functions and sequences, which are described in the preceding figures, of the intelligent protection system 52 are controlled and monitored or processed in two channels by microcontrollers 61 and 62 in the form of a program. Specific data of the two microcontrollers 61 and 62 are compared with each other in a state comparator 63. The program recognizes faults in the sequence of the switching operations of the safety circuit sensor system 2 (32), of the VVVF drive/control unit 51, of the frequency inverter power unit 50, of the brake control 53 and of the intelligent protection system 52 and prevents dangerous states of the elevator by blocking of the motor current and by switching-off of the brake current.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Monitoring equipment for a drive control for an elevator installation with a frequency converter drive, the drive control including an elevator drive motor regulated by a frequency converter for operating an elevator car, a brake for stopping the elevator car and a safety circuit for indicating operating states of the elevator installation, the monitoring equipment comprising:

a motor switching and/or brake switching circuit connected between a safety circuit and at least one of a drive motor and a brake for an elevator car associated with the safety circuit, said motor switching and/or brake switching circuit responding to operation of the safety circuit for operating at least one of the drive motor and the brake, the monitoring equipment being formed exclusively of electronic components without electromechanical contactors or relays for reducing acoustic noise and electrically conducting separating locations in the monitoring equipment;

a signal source connected to the safety circuit for supplying electrical power to the safety circuit;

a current sensor connected between the safety circuit and an evaluating unit for generating one output signal; and a voltage sensor connected to the safety circuit for generating another output signal, said motor switching and/or brake switching circuit being responsive to said output signals for operating at least one of the drive motor and the brake.

2. The monitoring equipment according to claim 1 wherein said signal source is a direct current signal source connected to the safety circuit for supplying electrical power to the safety circuit.

3. The monitoring equipment according to claim 1 wherein said signal source is an alternating current signal source connected to the safety circuit for supplying electrical power to the safety circuit.

4. The monitoring equipment according to claim 1 wherein said motor switching and/or brake switching circuit includes a frequency converter power unit, a drive/control unit of variable voltage and variable frequency, an intelligent protection system and a brake control connected together, wherein said intelligent protection system discerns all monitoring and controlling functions that are relevant to safety of the safety circuit, said drive/control unit, said frequency converter power unit and said brake control.

5. The monitoring equipment according to claim 4 wherein said intelligent protection system executes the monitoring and controlling functions, that are relevant to safety, in two channels and includes a state comparator for comparison of data generated in said two channels.

6. The monitoring equipment according to claim 5 including a microcontroller with a program in each said channel for processing the monitoring and controlling functions.

7. The monitoring equipment according to claim 4 including a microcontroller with a program for recognizing faults in an operating sequence of switching operations of the safety circuit, said drive/control unit, said frequency converter power unit, said brake control and said intelligent protection system whereby dangerous states of operation of the elevator are prevented.

8. Monitoring equipment for a drive control for an elevator installation, the drive control including an elevator drive motor for operating an elevator car, a brake for stopping the elevator car and a safety circuit for indicating operating states of the elevator installation, the monitoring equipment comprising:

a safety circuit sensor system for sensing operation of a safety circuit for an elevator;

a motor switching and/or brake switching circuit connected between said safety circuit sensor system and at least one of a drive motor and a brake for an elevator car associated with the safety circuit, said motor switching and/or brake switching circuit responding to operation of the safety circuit for operating at least one of the drive motor and the brake, the monitoring equipment being formed exclusively of electronic components for reducing acoustic noise and electrically conducting separating locations in the monitoring equipment;

a signal source connected to said safety circuit sensor system and for supplying electrical power to the safety circuit and wherein said safety circuit sensor system includes a current sensor connected to an evaluating unit for generating one output signal and a voltage sensor for generating another output signal, said motor switching and/or brake switching circuit being responsive to said output signals for operating at least one of the drive motor and the brake; and wherein said motor switching and/or brake switching circuit includes a frequency converter power unit, a drive/control unit of variable voltage and variable frequency, an intelligent protection system and a brake control connected together, wherein said intelligent protection system discerns all monitoring and controlling functions that are relevant to safety of said safety circuit sensor system, said drive/control unit, said frequency converter power unit and said brake control.

9. The monitoring equipment according to claim 8 wherein said signal source is a direct current signal source connected to said safety circuit sensor system for supplying electrical power to the safety circuit.

10. The monitoring equipment according to claim 8 wherein said signal source is an alternating current signal source connected to said safety circuit sensor system for supplying electrical power to the safety circuit.

11. The monitoring equipment according to claim 8 wherein said intelligent protection system executes the monitoring and controlling functions, that are relevant to safety, in two channels and includes a state comparator for comparison of data generated in said two channels.

12. The monitoring equipment according to claim 11 including a microcontroller with a program in each said channel for processing the monitoring and controlling functions.

13. The monitoring equipment according to claim 8 including a microcontroller with a program for recognizing faults in an operating sequence of switching operations of said safety circuit sensor system, said drive/control unit, said frequency converter power unit, said brake control and said intelligent protection system whereby dangerous states of operation of the elevator are prevented.

14. Monitoring equipment for a drive control for an elevator installation with a frequency converter drive, the drive control including an elevator drive motor regulated by a frequency converter for operating an elevator car, a brake for stopping the elevator car and a safety circuit for indicating operating states of the elevator installation, the monitoring equipment comprising:

a motor switching and/or brake switching circuit connected between a safety circuit and at least one of a drive motor and a brake for an elevator car associated with the safety circuit, said motor switching and/or brake switching circuit responding to operation of the safety circuit for operating at least one of the drive motor and the brake, the monitoring equipment being formed exclusively of electronic components without electromechanical contactors or relays for reducing acoustic noise and electrically conducting separating locations in the monitoring equipment;

a signal source connected to the safety circuit for supplying electrical power to the safety circuit; and a sensor connected to the safety circuit for generating an output signal representing a characteristic of the electrical power supplied by the signal source through the safety circuit, said motor switching and/or brake switching circuit being responsive to said output signal for operating at least one of the drive motor and the brake.

15. The monitoring equipment according to claim 14 wherein said signal source is one of a direct current signal source and an alternating current signal source connected to the safety circuit for supplying electrical power to the safety circuit.

16. The monitoring equipment according to claim 14 wherein said sensor is one of a current sensor and a voltage sensor.

17. A drive control for an elevator system with a frequency converter drive, the elevator system including at least one elevator car moved by a drive motor regulated by a frequency converter and stopped by a brake, a safety circuit including contacts generating signals representing operation of the safety circuit and a source of electrical power for operating the drive motor, the drive control comprising:

monitoring equipment being formed from electronic components without electromechanical contactors or relays having relatively low levels of noise generation, cross talk and shock potential including:

a signal source generating electrical power at at least one of a magnitude and a frequency different from a magnitude and frequency of a source of electrical power for operating a drive motor for moving an elevator car of the elevator system, said signal source being connected to contacts of the safety circuit;

a sensor connected to said signal source for sensing a characteristic of the signal source electrical power representing operation of the safety circuit contacts; and a motor switching and/or brake switching circuit connected to said sensor and between the safety circuit and at least one of the drive motor and a brake for the elevator car, said motor switching and/or brake circuit operating at least one of the drive motor and the brake in response to operation of the safety circuit contacts sensed by said sensor.

18. Monitoring equipment for a drive control for an elevator installation, the drive control including an elevator drive motor for operating an elevator car, a brake for stopping the elevator car and a safety circuit for indicating operating states of the elevator installation, the monitoring equipment comprising:

a safety circuit sensor system for sensing operation of a safety circuit for an elevator;

a motor switching and/or brake switching circuit connected between said safety circuit sensor system and at least one of a drive motor and a brake for an elevator car associated with the safety circuit, said motor switching and/or brake switching circuit responding to operation of the safety circuit for operating at least one of the drive motor and the brake, the monitoring equipment being formed exclusively of electronic components for reducing acoustic noise and electrically conducting separating locations in the monitoring equipment;

a signal source connected to said safety circuit sensor system and for supplying electrical power to the safety circuit and wherein said safety circuit sensor system includes a sensor connected to the safety circuit for generating an output signal representing a characteristic of the electrical power supplied by said signal source through the safety circuit, said motor switching and/or brake switching circuit being responsive to said output signal for operating at least one of the drive motor and the brake; and wherein said motor switching and/or brake switching circuit includes a frequency converter power unit, a drive/control unit of variable voltage and variable frequency, an intelligent protection system and a brake control connected together, wherein said intelligent protection system discerns all monitoring and controlling functions that are relevant to safety of said safety circuit sensor system, said drive/control unit, said frequency converter power unit and said brake control.

19. The monitoring equipment according to claim 18 wherein said signal source is one of a direct current signal source and an alternating current signal source connected to the safety circuit for supplying electrical power to the safety circuit.

20. The monitoring equipment according to claim 18 wherein said sensor is one of a current sensor and a voltage sensor.

* * * * *